United States Patent [19]

Sickinger

[11] 4,020,617

[45] May 3, 1977

[54] HEAT SHRINK PACKAGING MACHINE

[75] Inventor: Albert E. Sickinger, Bloomfield Hills, Mich.

[73] Assignee: Hans Sickinger Co., Pontiac, Mich.

[22] Filed: Oct. 22, 1975

[21] Appl. No.: 624,653

[52] U.S. Cl. ..... 53/229; 53/182 R; 53/184 S

[51] Int. Cl.[2] ..... B65B 11/10; B65B 53/02

[58] Field of Search ..... 53/30 S, 180 R, 182 R, 53/184 S, 229, 230, 154, 159

[56] References Cited

UNITED STATES PATENTS

| | | | |
|---|---|---|---|
| 3,188,782 | 6/1965 | Lapides | 53/229 |
| 3,585,777 | 6/1971 | Pesch | 53/229 X |
| 3,589,100 | 6/1971 | Konars et al | 53/229 X |
| 3,727,365 | 4/1973 | Stohlquist | 53/182 X |

*Primary Examiner*—Robert Louis Spruill
*Attorney, Agent, or Firm*—Harness, Dickey & Pierce

[57] ABSTRACT

Groups of spaced, aligned articles such as tape rolls are fed in succession to a station at which a heat-shrinkable film wrap is placed around the group of articles and sealed in a manner permitting looseness in the wrap. The group is then fed to a table conveyor leading to a heat shrink oven. To maintain positioning of the articles before reaching the table conveyor, a swinging gate maintains frictional engagement with the package.

3 Claims, 4 Drawing Figures

HEAT SHRINK PACKAGING MACHINE

BACKGROUND OF THE INVENTION

1. Field of the Invention

The invention relates to heat shrink packaging machines and more particularly to machines for packaging circular articles such as tape rolls with inert or non-adhesive heat-shrinkable film in a manner which permits the articles to be easily separated.

2. Description of the Prior Art

When objects such as stacked tape rolls are packaged, it has been necessary to place separators such as thin paper sheets between the rolls in order to prevent them from sticking together and to facilitate separation. Recently, a form of heat shrink package for articles such as stacked tape rolls has been developed. The articles are coaxially aligned in horizontally spaced relation with each other and a heat-shrinkable film is placed around them. If a self-adhering film is used, the wrap can be drawn tightly around the rolls at the wrapping station with the film ends being overlapped. This will hold the rolls in position while they are conveyed to the heat shrink oven. The oven causes the film between the articles to shrink. After discharge, the wrapped articles may be compressed, and the shrunk film between the articles will act as separators.

Self-adhering film does not lend itself, however, to overlapping when used to wrap articles such as tape rolls. It has been found that the film often does not hold and the package can come apart. For this reason it is desirable to use inert-heat-shrinkable film which is wrapped around the articles and cut with a hot wire to create a non-overlapping seam. However, this process necessarily leaves some looseness in the package until it reaches the heat shrink oven. This creates the possibility that one or more of the articles may become tipped or skewed during their movement from the wrapping station to the oven, especially if they are narrow and unstable.

BRIEF SUMMARY OF THE INVENTION

It is an object of the present invention to provide a novel and improved heat shrink packaging machine especially adapted for stacks of articles such as tape rolls and which permits nonadhesive film to be used as a wrap in a manner which creates separator portions between adjacent articles and at the same time prevents the articles from being shifted out of position as they are transferred from the wrap sealing station to the table conveyor.

Briefly, the illustrated embodiment of the invention is for a heat shrink packaging machine of the type having a wrapping station, means for guiding a row of spaced aligned articles such as tape rolls to said station, means for moving heat shrinkable film across the path of a row of articles advancing toward said station, and hot knife means engageable with said film on the trailing side of said row of articles to form a heat seal, and comprises a gate pivotally mounted at said station and suspended in the path of said row of articles forwardly of said film, and means maintaining constant engagement of said gate with said articles while at said station, said gate being yieldable to permit the wrapped articles to pass thereunder while maintaining engagement with the package to thereby prevent tilting of articles with respect to each other.

DESCRIPTION OF THE PREFERRED EMBODIMENT

Figure 2:
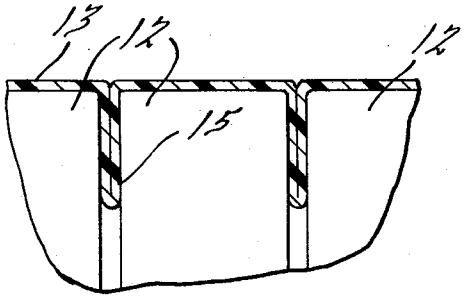
FIG. 2 is an enlarged fragmentary cross sectional view showing a portion of the package and illustrating how the film acts as a separator for adjacent articles.
Figure 1:
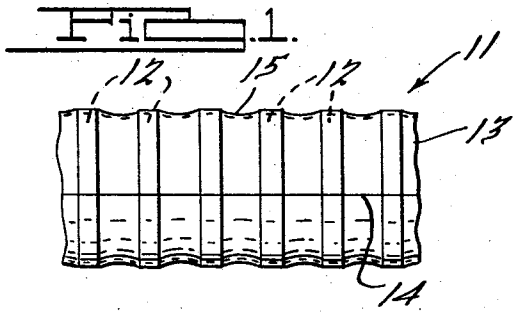
FIG. 1 is a fragmentary elevational view showing a portion of a package acted on in accordance with the principles of this invention, the packaging being shown in expanded position in order to see the configuration of the film.

FIG. 1 illustrates a typical package made by conventional equipment with which the present invention is utilized. The package is generally indicated at 11 and comprises a plurality of tape rolls 12 such as masking tape to be sold in a retail store. A wrapping of inert or non-adhesive heat shrinkable film 13 surrounds articles 12. This film is placed around the articles by conventional means in a manner such that two non-overlapping seams 14 are formed on opposite sides of the package. When originally wrapped, the articles are loosely held, but they pass through a heat-shrink oven which causes the film 13 to contract as indicated at 15 between the rolls which are in spaced relation. After leaving the oven, the rolls may be collapsed axially, with portions 15 of the wrap becoming doubled as indicated in FIG. 2. These folds thus act as separators to prevent the tape rolls 12 from sticking together. The package may be shipped in this fashion.

Figure 3:
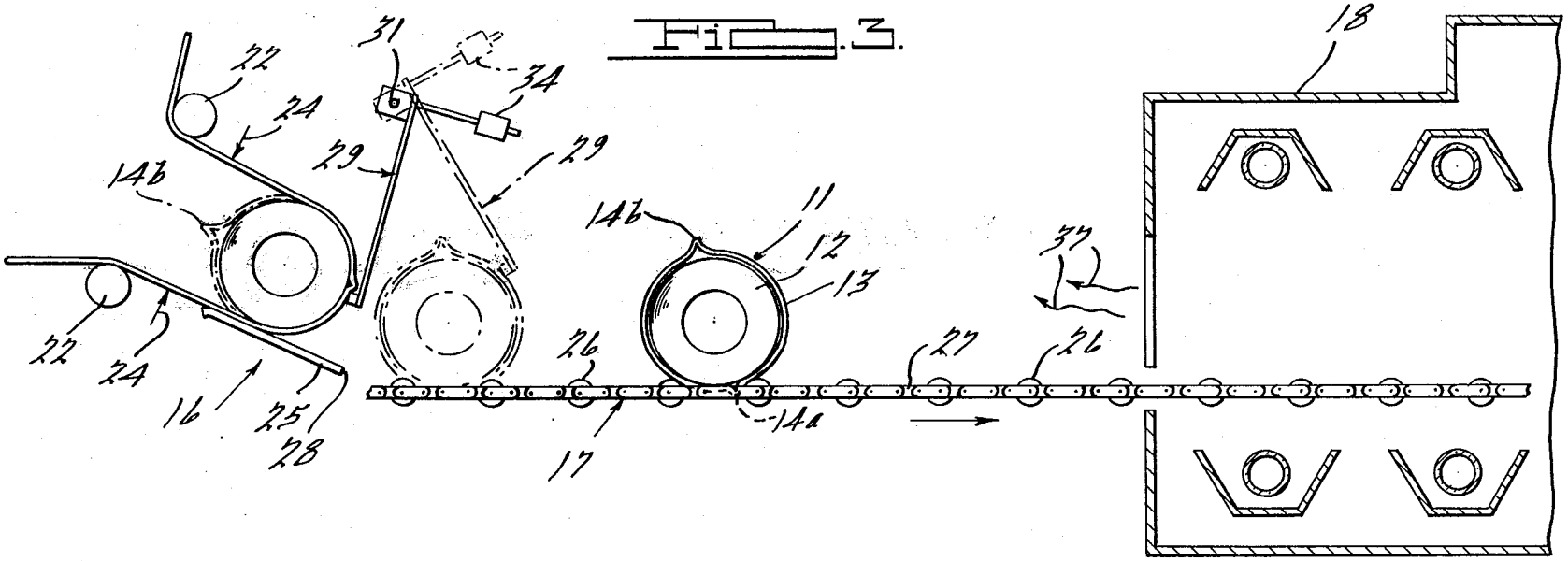
FIG. 3 is a schematic view showing the gate of the invention.
Figure 4:
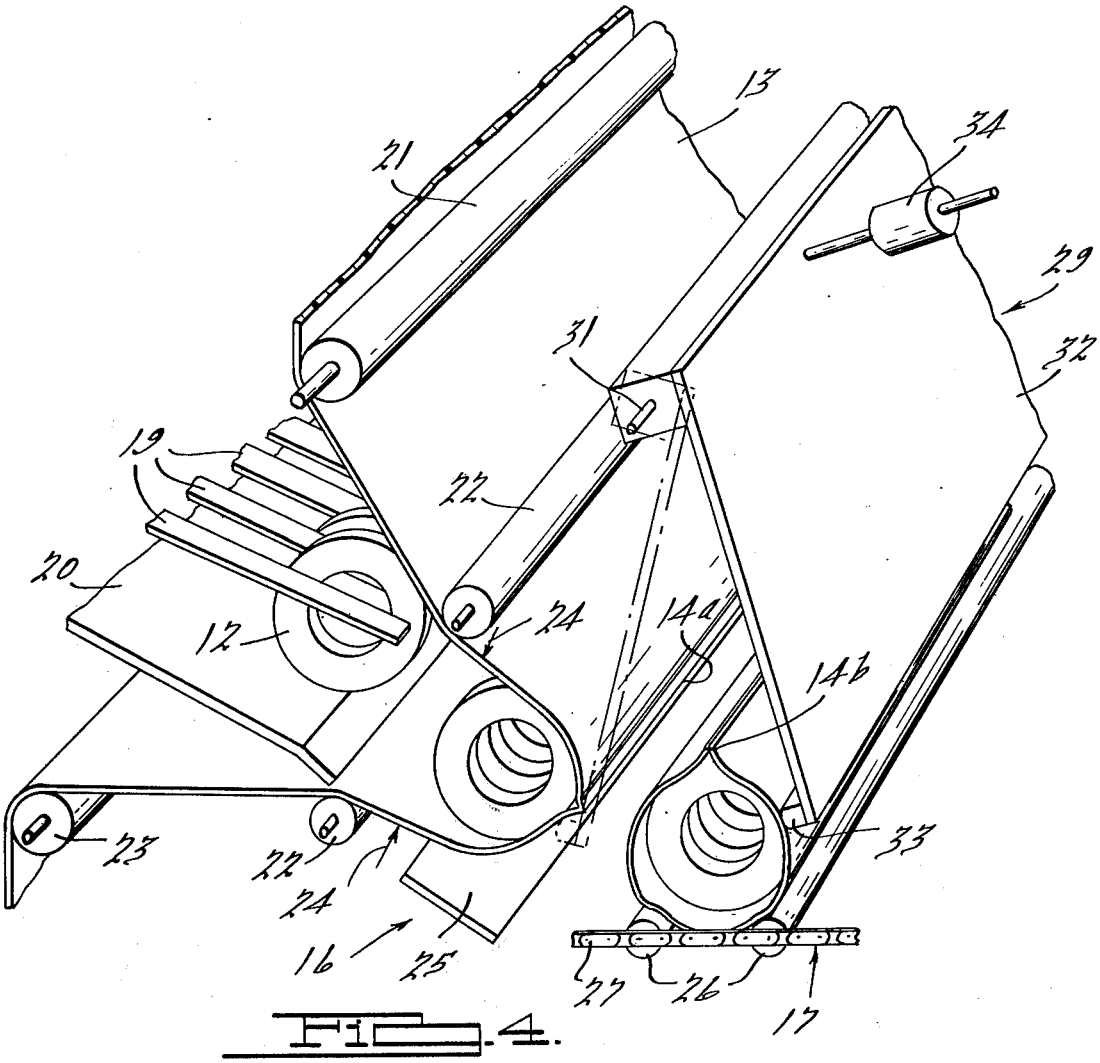
FIG. 4 is a simplified fragmentary perspective view showing how the gate maintains the proper spacing of the loosely wrapped articles until they are fully supported on the roller conveyor.

FIGS. 3 and 4 illustrate schematically a typical machine for carrying out the wrapping process with the improvement of this invention applied thereto. The machine has a wrapping station generally indicated at 16 at which each group of articles is loosely wrapped, and a conveyor generally indicated at 17 which carries the loosely wrapped articles to a heat shrink oven 18.

Each group of articles 12 is placed in coaxial spaced relation between a series of guides 19 disposed above a ramp 20. The film 13 is guided from a supply source (not shown) by rollers 21, 22 and 23 past the wrapping station 16 to which the lower end of ramp 20 guides the articles 12. Hot wire cutting means indicated schematically by arrows 24 are positioned at wrapping station 16 to approach each other periodically so as to form a non-overlapping seam 14 to the rear of each group of articles 12 which has been fed from ramp 20 onto a ramp 25. The seam 14 thus formed becomes a rear seam for the group being wrapped and a front seam for the next group. It will be observed in FIGS. 3 and 4 that, because of the nature of the wrapping mechanism, the seam at the rear of each group of articles (referred to as **14*b* in FIGS. 3 and 4, the leading seam being 14*a*) is some distance away from the package being wrapped. This looseness could ordinarily be detrimental when the loosely wrapped package descends from ramp 25 to reach conveyor 17.**

Conveyor 17 comprises a plurality of spaced parallel rollers 26 extending transversely to the direction of conveyor movement, these rollers being connected at their ends by chains 27. The spacing of rollers 26 is such that each loosely wrapped package 11 will be cradled between two adjacent rollers. However, the package must drop from the lower edge 28 of rack 25 to its cradled position. With narrow articles 12, loosely wrapped, this drop could cause skewing or tilting of one or more articles with the result that when the heat shrink material passes through the oven, it will "freeeze" the articles in their skewed position making an unsatisfactory final package.

According to the invention, a gate generally indicated at 29 is pivotally mounted at 31 adjacent wrapping station 16, approximately above the lower portion of ramp 25. This gate comprises a plate 32 secured at its upper edge to pivot means 31 and carrying a rubber-like or other friction strip 33 along its lower edge facing the approaching packages 11. Means such as a counterweight 34 are provided for urging gate 29 to a normal position shown in solid lines in FIG. 3 and dot-dash lines in FIG. 4. When in this position, edge 33 is urged against the forward side of a package 11 on ramp 25. The light but firm pressure exerted by the continuous strip 33 on the package will frictionally hold articles 12 in a manner inhibiting their ability to skew or tilt transversely to their direction of movement. At the same time, gate 29 will be yieldable, permitting the packages to roll of their own weight down ramp 25 as gate 29 swings counterclockwise. The rolling action of the package will not prevent the continued function of strip 33 in inhibiting sideways tilting of the articles 12 within the package. After each package 11 is securely nested between a pair of adjacent rollers 26, the conveyor 17 will carry the package under gate 29 until strip 33 clears the package and counterweight 34 returns the gate to its original position in readiness for engaging the next package released from ramp 21.

It should be observed that gate 29 in no way interferes with the normal functioning of the remaining parts of the machine, and particularly the operation of the cutting and sealing means 24 and conveyor 17. The force of counterbalancing means 34 may of course be varied to suit requirements.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. In a heat shrink packaging machine of the type having a wrapping station, means for guiding a row of spaced aligned articles such as tape rolls to said station, means for moving heat shrinkable film across the path of a row of articles advancing toward said station, and hot knife means engageable with said film on the trailing side of said row of articles to form a heat seal, the improvement comprising a gate pivotally mounted at said station on a fixed pivot and suspended in the path of said row of articles forwardly of said film, and means maintaining constant engagement of said gate with said articles while at said station and while passing under said gate, said gate being yieldable while still maintaining said constant engagement to permit the wrapped articles to pass thereunder while maintaining engagement with the package to thereby prevent tilting of articles with respect to each other.

2. The combination according to claim 1, said gate having a friction strip along its lower edge engageable with said wrapped article.

3. The combination according to claim 1, said engagement maintaining means comprising a counterweight carried by the gate.

* * * * *